US010724713B1

(12) United States Patent
Cho et al.

(10) Patent No.: US 10,724,713 B1
(45) Date of Patent: Jul. 28, 2020

(54) CONNECTION DEVICE AND FLEXIBLE LIGHTING SYSTEM WITH THE SAME

(71) Applicant: FEELUX Co., LTD., Gyeonggi-do (KR)

(72) Inventors: Beom Yeon Cho, Seoul (KR); Jun Jang, Seoul (KR)

(73) Assignee: FEELUX CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/707,335

(22) Filed: Dec. 9, 2019

(30) Foreign Application Priority Data

Jan. 25, 2019 (KR) ..... 10-2019-0009705
Oct. 25, 2019 (KR) ..... 10-2019-0133655

(51) Int. Cl.

| | |
|---|---|
| ***F21V 21/005*** | (2006.01) |
| ***F21V 15/00*** | (2015.01) |
| ***F21S 4/22*** | (2016.01) |
| ***H01R 33/18*** | (2006.01) |
| ***F21V 23/06*** | (2006.01) |
| *F21Y 103/10* | (2016.01) |
| *F21Y 115/10* | (2016.01) |

(52) U.S. Cl.
CPC ..... *F21V 21/005* (2013.01); *F21S 4/22* (2016.01); *F21V 15/00* (2013.01); *F21V 23/06* (2013.01); *H01R 33/18* (2013.01); *F21Y 2103/10* (2016.08); *F21Y 2115/10* (2016.08)

(58) Field of Classification Search
CPC ..... F21V 23/06; F21V 15/00; F21S 4/22
See application file for complete search history.

(56) References Cited

U.S. PATENT DOCUMENTS

2012/0000104 A1* 1/2012 Peeters ..... H05K 1/189 40/541
2017/0038036 A1* 2/2017 Guerrieri ..... F21S 4/24
2019/0252839 A1* 8/2019 Frederiksen ..... F21V 23/06

FOREIGN PATENT DOCUMENTS

KR 10-1281547 B1 7/2013

* cited by examiner

*Primary Examiner* — Evan P Dzierzynski
(74) *Attorney, Agent, or Firm* — The PL Law Group, PLLC

(57) ABSTRACT

A connection device according to an embodiment disclosed herein is a connection device connected to a flexible lighting device and includes a body part, a connection terminal protruding toward the flexible lighting device from the body part and electrically connected to the flexible lighting device, a lighting device guide part provided to protrude toward the flexible lighting device from the body part, configured to guide the flexible lighting device to be inserted into the connection device and having one or more side surfaces provided to be open, and a clip part coupled to an outer side of the lighting device guide part at one open side surface of the lighting device guide part and provided to be fixed to one side surface of the flexible lighting device, which is exposed to the outside due to the one open side surface.

16 Claims, 11 Drawing Sheets

CONNECTION DEVICE AND FLEXIBLE LIGHTING SYSTEM WITH THE SAME

CROSS-REFERENCE TO RELATED APPLICATION

This application claims priority to and the benefit of Korean Patent Application No. 10-2019-0009705, filed on Jan. 25, 2019 and Korean Patent Application No. 10-2019-0133655, filed on Oct. 25, 2019, the disclosure of which is incorporated herein by reference in its entirety.

BACKGROUND

1. Field

Embodiments of the present disclosure relate to a connection technique of a flexible lighting device.

2. Discussion of Related Art

Recently, as the trend of light weight and miniaturization of electronic equipment increases, a technique for mounting light-emitting diode (LED) chips on a printed circuit board (PCB) or a flexible printed circuit board (FPCB) has been developed. Here, lighting devices with the LED chips mounted on the FPCB are flexible lighting devices, and the flexible lighting devices have an extra portion formed in a wiring pattern on the FPCB at every predetermined length so that a user may use a flexible lighting device having a desired length by cutting the extra portion. In order to connect the flexible lighting devices to each other, a separate connection device is required.

SUMMARY

Embodiments of the present disclosure provide a connection device capable of stably connecting flexible lighting devices to each other and a flexible lighting system with the same.

According to an aspect of the present disclosure, there is a connection device that is a connection device connected to a flexible lighting device and includes a body part, a connection terminal protruding toward the flexible lighting device from the body part and electrically connected to the flexible lighting device, a lighting device guide part provided to protrude toward the flexible lighting device from the body part, configured to guide the flexible lighting device to be inserted into the connection device, and having one or more side surfaces provided to be open, and a clip part coupled to an outer side of the lighting device guide part at one open side surface of the lighting device guide part and provided to be fixed to one side surface of the flexible lighting device which is exposed to the outside due to the one open side surface.

The clip part may include at least one fixing protrusion provided on a surface thereof facing the one open side surface of the lighting device guide part, and the fixing protrusion may be provided to be stuck into and fixed to the one side surface of the flexible lighting device, which is exposed to the outside due to the one open side surface, when the clip part is coupled to the outer side of the lighting device guide part.

The lighting device guide part may include a first guide part extending toward the flexible lighting device from an upper end of the body part, a second guide part extending toward the flexible lighting device from a lower end of the body part, and a support frame provided to connect an end of the first guide part to an end of the second guide part.

The connection device may further include a power connection part provided in the body part at a side opposite to the flexible lighting device and having one side connected to the connection terminal and the other side electrically connected to a power supply.

The clip part may include a first plate provided to face the one open side surface of the lighting device guide part, a second plate protruding toward the lighting device guide part from an upper end of the first plate and provided with a first engaging part at an end thereof, and a third plate protruding toward the lighting device guide part from a lower end of the first plate and provided with a second engaging part at an end thereof.

The lighting device guide part may further include a first engaging groove provided at an upper end of the lighting device guide part so that the first engaging part is caught by the first engaging groove, and a second engaging groove provided at a lower end of the lighting device guide part so that the second engaging part is caught by the second engaging groove.

The clip part may further include at least one fixing protrusion provided to protrude from an inner surface of the first plate and stuck into and fixed to the one side surface of the flexible lighting device which is exposed to the outside due to the one open side surface of the lighting device guide part.

The connection device may be provided to connect two flexible lighting devices by forming the connection terminal, the lighting device guide part, and the clip part in a pair so as to be laterally symmetrical with respect to the body part.

The connection device may include a first connection device provided at one side of the body part such that a first-type flexible lighting device is connected thereto and including a first connection terminal, a first lighting device guide part, and a first clip part, and a second connection device provided at the other side of the body part such that a second-type flexible lighting device is connected thereto and including a second connection terminal, a second lighting device guide part, and a second clip part.

According to another aspect of the present disclosure, there is a flexible lighting system including a flexible lighting device, and a connection device connected to the flexible lighting device, wherein the connection device includes a body part, a connection terminal protruding toward the flexible lighting device from the body part and electrically connected to the flexible lighting device, a lighting device guide part provided to protrude toward the flexible lighting device from the body part, configured to guide the flexible lighting device to be inserted into the connection device, and having one or more side surfaces provided to be open, and a clip part coupled to an outer side of the lighting device guide part at one open side surface of the lighting device guide part and provided to be fixed to one side surface of the flexible lighting device which is exposed to the outside due to the one open side surface.

The clip part may include at least one fixing protrusion provided on a surface thereof facing the one open side surface of the lighting device guide part, and the fixing protrusion may be provided to be stuck into and fixed to the one side surface of the flexible lighting device, which is exposed to the outside due to the one open side surface, when the clip part is coupled to the outer side of the lighting device guide part.

The flexible lighting device may include a flexible board, an illumination device provided on the flexible board, a wiring pattern electrically connected to the illumination device on the flexible board, and at least one cutting mark provided on one surface of the flexible board in a longitudinal direction of the flexible board, wherein the cutting mark may be provided to be identifiable from the outside.

The wiring pattern may be provided on a lower surface of the flexible board in the longitudinal direction of the flexible board, and the cutting mark may be marked on the lower surface of the flexible board so as to be identifiable from the outside.

The flexible lighting device may further include a protection part provided to cover at least one surface of the flexible board, and a light-shielding part provided on at least one outer surface of the flexible lighting device so that a direction of the illumination device coincides with a light irradiation direction of the flexible lighting device.

The flexible lighting device may further include a protection part provided to cover at least one surface of the flexible board, and a light-shielding part provided on at least one outer surface of the flexible lighting device so that a direction of the illumination device does not coincide with a light irradiation direction of the flexible lighting device.

The connection terminal may be provided at a height corresponding to the wiring pattern such that an end of the connection terminal becomes smaller in thickness toward the flexible lighting device to be brought into contact with the wiring pattern.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION

Hereinafter, embodiments of the present disclosure will be described in detail with reference to the accompanying drawings. The following detailed description is provided to assist the reader in gaining a comprehensive understanding of the methods, apparatuses, and/or systems described herein. However, the description is only exemplary, and the present disclosure is not limited thereto.

In describing the embodiments of the present disclosure, when it is determined that a detailed description of known techniques associated with the present disclosure would unnecessarily obscure the subject matter of the present disclosure, the detailed description thereof will be omitted. Also, terms used herein are defined in consideration of the functions of the present disclosure and may be changed depending on a user, the intent of an operator, or a custom. Accordingly, the terms should be defined on the basis of the following overall description of the present specification. The terms used in the following detailed description are provided only to describe the embodiments of the present disclosure and not for purposes of limitation. The singular forms "a," "an," and "the" are intended to include the plural forms as well, unless the context clearly indicates otherwise. It should be understood that the terms "comprises," "comprising," "includes," and/or "including," specify the presence of stated features, integers, steps, operations, elements, and/or components when used herein, but do not preclude the presence or addition of one or more other features, integers, steps, operations, elements, components, and/or groups thereof.

Meanwhile, directional terms such as an upper side, a lower side, one side, the other side, and the like are used in connection with the orientation of the disclosed drawings. The components of the embodiments of the present disclosure may be positioned in various orientations such that the directional terminology is used for purposes of illustration and is not intended to be limiting.

In addition, while terms such as "first," or "second," and the like may be used to describe various components, such components should not be limited to the above terms. These terms may be used only to distinguish one component from another component. For example, a first component may be referred to as a second component, and, similarly, a second component may be referred to as a first component without departing from the scope of the present disclosure.

Figure 1:
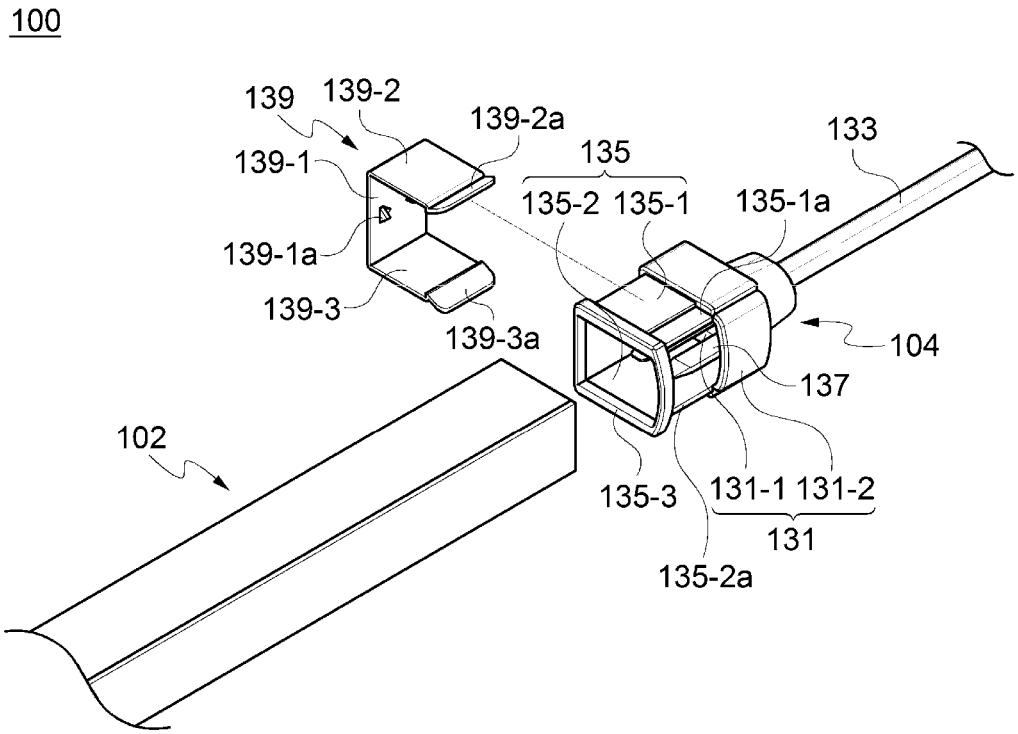
FIG. 1 is a view illustrating a flexible lighting system according to an embodiment of the present disclosure.
Figure 2:
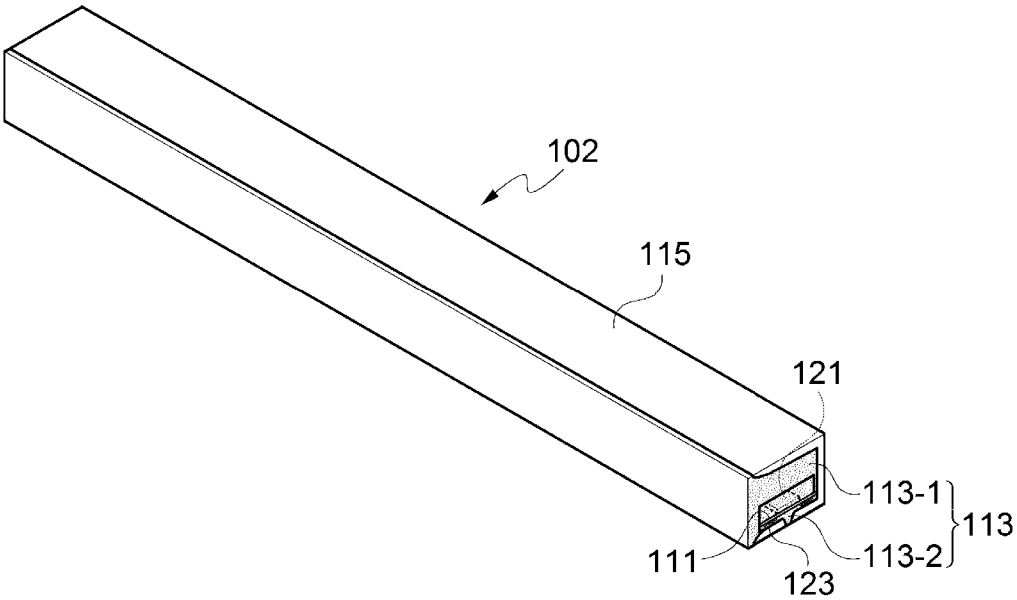
FIG. 2 is a perspective view illustrating a flexible lighting device according to an embodiment of the present disclosure.
Figure 3:
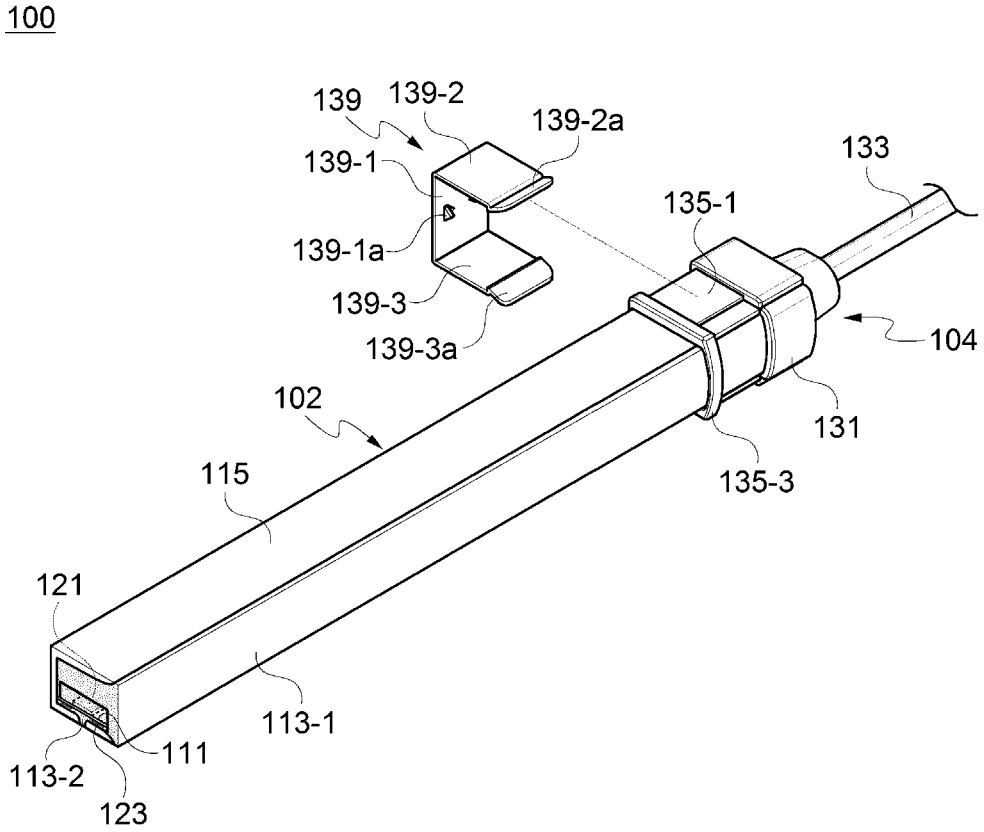
FIG. 3 is a perspective view illustrating a state in which the flexible lighting device and a connection device according to an embodiment of the present disclosure are coupled to each other.
Figure 4:
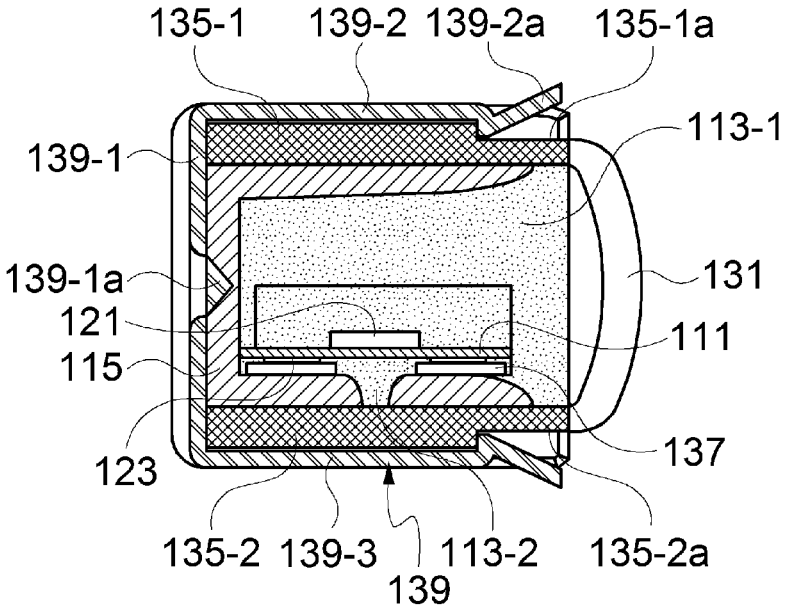
FIG. 4 is a cross-sectional view illustrating a state in which the flexible lighting device and the connection device according to an embodiment of the present disclosure are coupled to each other.

FIG. 1 is a view illustrating a flexible lighting system according to an embodiment of the present disclosure, FIG. 2 is a perspective view illustrating a flexible lighting device according to an embodiment of the present disclosure, FIG. 3 is a perspective view illustrating a state in which the flexible lighting device and a connection device according to an embodiment of the present disclosure are coupled to each other, and FIG. 4 is a cross-sectional view illustrating a state in which the flexible lighting device and the connection device according to an embodiment of the present disclosure are coupled to each other.

Referring to FIGS. 1 to 4, a flexible lighting system 100 may include a flexible lighting device 102 and a connection device 104.

The flexible lighting device 102 is a lighting device provided to be flexible. The flexible lighting device 102 may include a flexible board 111, a protection part 113, and a light-shielding part 115.

A flexible printed circuit board (FPCB) may be used as the flexible board 111. One or more illumination devices 121 may be mounted on one surface of the flexible board 111. A light-emitting diode (LED) or the like may be used as the illumination device 121. In an exemplary embodiment, a plurality of illumination devices 121 may be arranged to be spaced apart from each other on the flexible board 111 in a longitudinal direction of the flexible board 111. The flexible board 111 may include a wiring pattern 123 electrically connected to the illumination devices 121. In an exemplary embodiment, the wiring pattern 123 may be provided on the other surface of the flexible board 111 in the longitudinal direction of the flexible board 111. However, a location of the wiring pattern 123 is not limited thereto and the wiring pattern 123 may be provided at other locations, such as one surface of the flexible board 111.

The protection part 113 may protect the flexible board 111 from an external environment. In an exemplary embodiment, the protection part 113 may include a first protection part 113-1 provided to surround the flexible board 111 on one surface of the flexible board 111, and a second protection part 113-2 provided to surround the flexible board 111 on the other surface of the flexible board 111. The protection part 113 may be made of an insulating material. The protection part 113 may also be made of a material capable of transmitting light. Here, the first protection part 113-1 may perform a role of allowing light generated by the illumination device 121 to be transmitted and irradiated to the outside. Meanwhile, the protection part 113 is described herein as including the first protection part 113-1, but the present disclosure is not limited thereto, and the protection part 113 may be configured with the second protection part 113-2 without including the first protection part 113-1.

The light-shielding part 115 may be provided on an outer side of the protection part 113. The light-shielding part 115 may be made of a material that does not transmit light. Alternatively, the light-shielding part 115 may be made of a material that does not transmit and reflects light. The light-shielding part 115 may perform a role of guiding the light generated by the illumination device 121 to be irradiated onto one surface (a surface on which the light-shielding part 115 is not formed) of the protection part 113.

In an exemplary embodiment, the light-shielding part 115 may be provided on one side surface and an upper surface of the first protection part 113-1 and a lower surface of the second protection part 113-2. In this case, the light-shielding part 115 is not formed on the other side surface of the first protection part 113-1, and the light generated by the illumination device 121 is irradiated to the other side surface of the first protection part 113-1, on which the light-shielding part 115 is not formed. The light-shielding part 115 is not excluded from a role of completely preventing the light from being transmitted therethrough but may perform a role of allowing the light generated by the illumination device 121 to be irradiated to the other side surface of the first protection part 113-1, on which the light-shielding part 115 is not formed.

Here, a direction of the illumination device 121 does not match a light irradiation direction but is perpendicular to the light irradiation direction. Such a flexible lighting device may be referred to as a "first-type flexible lighting device".

The connection device 104 may perform a role of transmitting power to the flexible lighting device 102. The connection device 104 may include a body part 131, a power connection part 133, a lighting device guide part 135, a connection terminal 137, and a clip part 139. The body part 131 may be made of an insulating material. The body part 131 may include a first body part 131-1 and a second body part 131-2. The first body part 131-1 may be provided to face one end of the flexible lighting device 102. The first body part 131-1 may be provided in a shape corresponding to a cross section of the flexible lighting device 102. The second body part 131-2 may be provided to protrude toward the flexible lighting device 102 from each edge of the first body part 131-1.

The power connection part 133 may be provided at one side of the body part 131. One end of the power connection part 133 may be electrically connected to the connection terminal 137. The other end of the power connection part 133 may be electrically connected to a power supply (not shown). The power supply (not shown) may be, for example, a switching mode power supply (SMPS).

The lighting device guide part 135 may be provided to protrude toward the flexible lighting device 102 from the body part 131. The body part 131 and the lighting device guide part 135 may be made of a transparent material or a translucent material but are not limited thereto and may be made of an opaque material.

In an exemplary embodiment, the lighting device guide part 135 may be provided to extend toward the flexible lighting device 102 from an end of the second body part 131-2. The lighting device guide part 135 may guide the flexible lighting device 102 to be inserted into the connection device 104. The lighting device guide part 135 may be brought into contact with at least one surface of the flexible lighting device 102 and guide the flexible lighting device 102 so that the at least one surface to be brought into contact with the lighting device guide part 135 is inserted into the connection device 104.

In addition, one or more side surfaces of the lighting device guide part 135 may be provided to be open. In this case, when the flexible lighting device 102 is inserted into the connection device 104, one or more side surfaces of the flexible lighting device 102 are exposed to the outside due to the open side surfaces of the lighting device guide part 135.

In an exemplary embodiment, the lighting device guide part 135 may include a first guide part 135-1 and a second guide part 135-2. The first guide part 135-1 may extend toward the flexible lighting device 102 from an upper end of the second body part 131-2. The second guide part 135-2 may extend toward the flexible lighting device 102 from a lower end of the second body part 131-2. In this case, both side surfaces of the lighting device guide part 135 are open.

Here, the first guide part 135-1 and the second guide part 135-2 may have step portions with the upper and lower ends of the second body part 131-2, respectively. That is, a surface of the first guide part 135-1 and an upper-end surface of the second body part 131-2 may be stepped, and a surface of the second guide part 135-2 and a lower-end surface of the second body part 131-2 may be stepped.

Meanwhile, a support frame 135-3 may be provided at an end of the lighting device guide part 135. The support frame 135-3 may be provided to correspond to a cross-sectional shape of the flexible lighting device 102 at the end of the lighting device guide part 135. The support frame 135-3 may be provided along an edge of the end of the lighting device guide part 135. In this case, the flexible lighting device 102 is inserted into the support frame 135-3. The support frame 135-3 may be provided to connect ends of the first guide part 135-1 and the second guide part 135-2.

One end of the connection terminal 137 is electrically connected to the power connection part 133 through the body part 131. In an exemplary embodiment, the connection terminal 137 may be provided to protrude toward the flexible lighting device 102 from the first body part 131-1. One end of the connection terminal 137 may be electrically connected to the power connection part 133 in the first body part 131-1. The other end of the connection terminal 137 is electrically connected to the flexible lighting device 102.

Specifically, when a user inserts the flexible lighting device 102 into the connection device 104, the other end of the connection terminal 137 may be brought into contact with the wiring pattern 123 provided on the flexible board 111. For example, when the wiring pattern 123 is provided on a lower surface of the flexible board 111, the other end of the connection terminal 137 may be brought into contact with the wiring pattern 123 while being inserted into the lower portion of the flexible board 111 by fitting.

The other end of the connection terminal 137 may have a smaller thickness toward the flexible lighting device 102. In this case, when the flexible lighting device 102 is inserted into the connection device 104, the other end of the connection terminal 137 enters into a space between the flexible board 111 and the second protection part 113-2, thereby being brought into contact with the wiring pattern 123.

The clip part 139 may be coupled to an outer side of the lighting device guide part 135. The clip part 139 may be coupled to the lighting device guide part 135 at one open side surface of the lighting device guide part 135. The clip part 139 may be coupled to the lighting device guide part 135 while closing one open side surface of the lighting device guide part 135. In this case, the clip part 139 may be brought into close contact with and fixed to the side surface of the flexible lighting device 102, which is exposed to the outside due to one open side surface of the lighting device guide part 135.

In an exemplary embodiment, the clip part 139 may include a first plate 139-1, a second plate 139-2, and a third plate 139-3. The first plate 139-1 may be provided to face one open side surface of the lighting device guide part 135. The second plate 139-2 may be provided to protrude toward the lighting device guide part 135 from an upper end of the first plate 139-1. The third plate 139-3 may be provided to protrude toward the lighting device guide part 135 from a lower end of the first plate 139-1.

The first plate 139-1 may close one open side surface of the lighting device guide part 135. The second plate 139-2 may be seated on an upper end of the lighting device guide part 135 (i.e., the first guide part 135-1). A first engaging part 139-2*a* may be provided at an end of the second plate 139-2. The first engaging part 139-2*a* may be provided to be bent downward and then inclined upward. The third plate 139-3 may be seated on a lower end of the lighting device guide part 135 (i.e., the second guide part 135-2). A second engaging part 139-3*a* may be provided at an end of the third plate 139-3. The second engaging part 139-3*a* may be provided to be bent upward and then inclined downward.

The first guide part 135-1 may include a first engaging groove 135-1*a* provided to be stepped with the surface of the first guide part 135-1. The second guide part 135-2 may include a second engaging groove 135-2*a* provided to be stepped with the surface of the second guide part 135-2. When the clip part 139 is mounted to the lighting device guide part 135 at one open side surface of the lighting device guide part 135, the first engaging part 139-2*a* is caught by the first engaging groove 135-1*a* and the second engaging part 139-3*a* is caught by the second engaging groove 135-2*a*, and thus the clip part 139 is coupled to the lighting device guide part 135.

Meanwhile, one or more fixing protrusions 139-1*a* may protrude from an inner surface of the first plate 139-1 (i.e., the surface facing one open side surface of the lighting device guide part 135). When the clip part 139 is coupled to the lighting device guide part 135 at one open side surface of the lighting device guide part 135, the fixing protrusions 139-1*a* may be stuck into and fixed to the side surface of the flexible lighting device 102, which is exposed to the outside due to one open side surface of the lighting device guide part 135 (the surface on which the light-shielding part 115 is formed).

That is, the fixing protrusions 139-1*a* may be provided with an end in a pointed shape and may be stuck into the side surface of the flexible lighting device 102. Accordingly, the coupling between the connection device 104 and the flexible lighting device 102 may be secured, and the connection device 104 may be prevented from being detached.

In a disclosed embodiment, since both side surfaces of the connection device 104 are provided to be open, the clip part 139 is fixed to the side surface of the flexible lighting device 102 through one open side surface of the connection device 104, and a direction in which the flexible lighting device 102 irradiates light is exposed to the outside through the other open side surface of the connection device 104, thereby minimizing light interference.

Figure 5A:
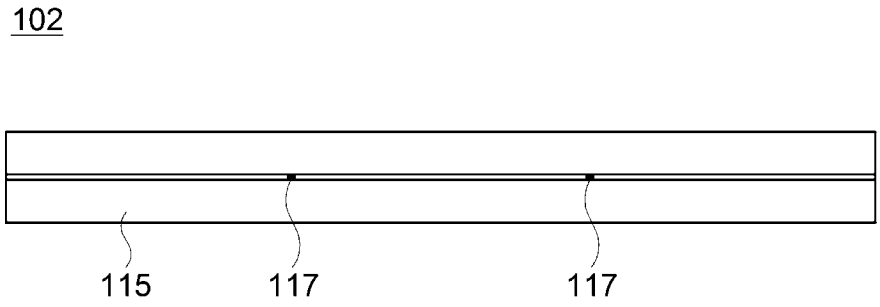
FIGS. 5A and 5B are a bottom view and a cross-sectional view, respectively, of the flexible lighting device according to an embodiment of the present disclosure.
Figure 5B:
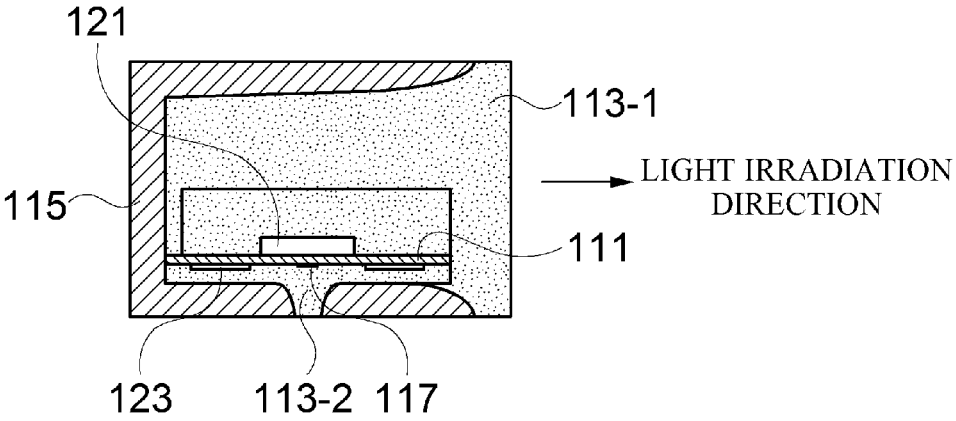

FIGS. 5A and 5B are a bottom view and a cross-sectional view, respectively, of the flexible lighting device according to an embodiment of the present disclosure.

Referring to FIGS. 5A and 5B, a cutting mark 117 indicating a portion of the flexible lighting device 102 to be cut may be marked on a lower surface of the flexible lighting device 102. Here, the cutting mark 117 may be marked on the lower surface of the flexible board 111. A plurality of cutting marks 117 may be provided on the lower surface of the flexible board 111 to be spaced apart from each other in the longitudinal direction of the flexible board 111. In addition, the cutting marks 117 may be provided to be identifiable from the outside.

In an exemplary embodiment, the cutting marks 117 may be marked on the lower surface of the flexible board 111. For example, the plurality of cutting marks 117 may be provided on the lower surface of the flexible board 111 along a center of the flexible board 111. The first protection part 113-1 may be provided to surround an upper surface of the flexible board 111, and the second protection part 113-2 may be provided to surround the lower surface of the flexible board 111.

In addition, the light-shielding part 115 may be provided on the one side surface (left side surface in FIG. 5B) and the upper surface of the first protection part 113-1 and the lower surface of the second protection part 113-2. In this case, the light-shielding part 115 is not formed on the other side surface (right side surface in FIG. 5B) of the first protection part 113-1, and the light generated by the illumination device 121 is irradiated to the other side surface of the first protection part 113-1 on which the light-shielding part 115 is not formed.

That is, in the flexible lighting device 102, although the illumination device 121 is formed in an upward direction, the light irradiation direction is a rightward direction. The first-type flexible lighting device may be used by being bent in the upward direction and in a downward direction with respect to the surface on which the flexible board 111 is placed. In other words, a bending direction of the first-type flexible lighting device may be a direction perpendicular to the light irradiation direction.

Here, the light-shielding part 115 may not be formed on the lower surface of the second protection part 113-2 in a center region of the flexible board 111 on which the cutting marks 117 are marked. In this case, since the second protection part 113-2 is made of a material capable of transmitting light, the cutting mark 117 may be visible to a user's eyes under the flexible lighting device 102 so that the user may identify the cutting mark 117.

In addition, the light-shielding part 115 may be formed on the one side surface and the upper surface of the first protection part 113-1, and only the second protection part 113-2 may be formed on the lower surface of the flexible board 111. Even in this case, the cutting mark 117 may be visible to the user's eyes under the flexible lighting device 102 so that the user may identify the cutting mark 117.

In addition, the cutting mark 117 may be provided to be identifiable from the outside by forming openings in the flexible lighting device 102 in portions on which the cutting marks 117 are formed. For example, the openings may be formed on the lower surface of the flexible lighting device 102 along the center of the flexible lighting device 102. However, the present disclosure is not limited thereto, and the cutting marks 117 may be provided on the lower surface of the flexible board 111 and may be provided in various forms that may be identified from the outside.

As described above, the cutting mark 117 is provided on the lower surface of the flexible board 111 so as to be identifiable from the outside so that the user may accurately find and cut the portion of the flexible lighting device 102 to be cut through the cutting marks 117 even when the flexible lighting device 102 is bent.

That is, even when the flexible lighting device 102 is provided to be cut in various portions, if the cutting marks 117 are marked on an outer surface of the flexible lighting device 102, the cutting mark 117 may be moved when the flexible lighting device 102 is bent so that the cutting mark 117 may not match a portion to be actually cut. However, when the cutting mark 117 is provided on the lower surface of the flexible board 111 and is provided to be identifiable from the outside, the cutting mark 117 matches the portion to be actually cut even when the flexible lighting device 102 is bent so that the user may properly find and cut the portion of the flexible lighting device 102 to be cut.

Figure 6:
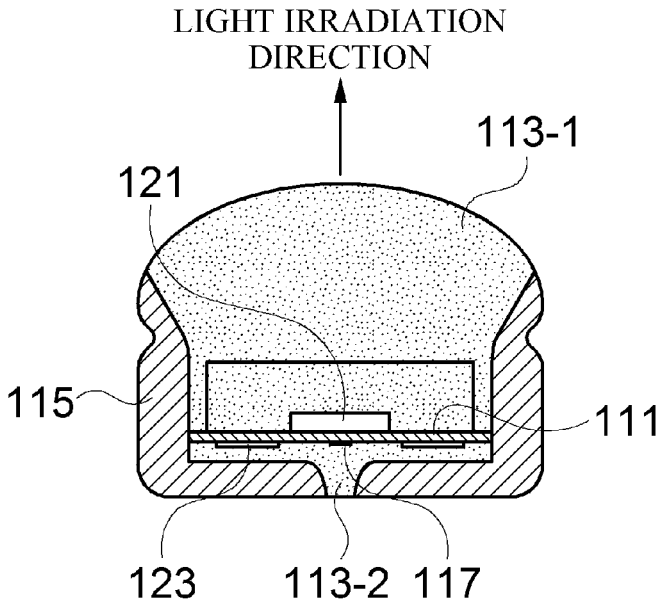
FIG. 6 is a cross-sectional view illustrating a flexible lighting device according to another embodiment of the present disclosure.

FIG. 6 is a cross-sectional view illustrating a flexible lighting device according to another embodiment of the present disclosure. Here, the parts that are different from those of the embodiment described with reference to FIG. 2 will be mainly described.

Referring to FIG. 6, a light-shielding part 115 may be provided on both side surfaces of a first protection part 113-1 and a lower surface of a second protection part 113-2. In this case, the light-shielding part 115 is not formed on an upper surface of the first protection part 113-1, and light generated by an illumination device 121 is irradiated to the upper surface of the first protection part 113-1, on which the light-shielding part 115 is not formed.

That is, in a flexible lighting device 102, the illumination device 121 is formed in an upward direction, and a light irradiation direction is also the upward direction. As described above, the flexible lighting device in which a direction of the illumination device 121 matches the light irradiation direction may be referred to as a "second-type flexible lighting device".

The second-type flexible lighting device may be used by being bent in the upward direction, which is the light irradiation direction, and in a downward direction, which is opposite to the light irradiation direction. In other words, a bending direction of the second-type flexible lighting device may be the upward direction, which is the light irradiation direction, and the downward direction, which is opposite to the light irradiation direction.

In a disclosed embodiment, ease of installation of the flexible lighting device 102 may be increased by making a bending direction of the flexible lighting device 102 coincides with the direction perpendicular to the light irradiation direction in the first-type flexible lighting device and by making the bending direction of the flexible lighting device 102 coincides with the light irradiation direction and the direction opposite to the light irradiation direction in the second-type flexible lighting device. In addition, when the first-type flexible lighting device and the second-type flexible lighting device are connected through the connection device, the lighting devices may be displayed in various ways by varying the light irradiation direction.

Figure 7:
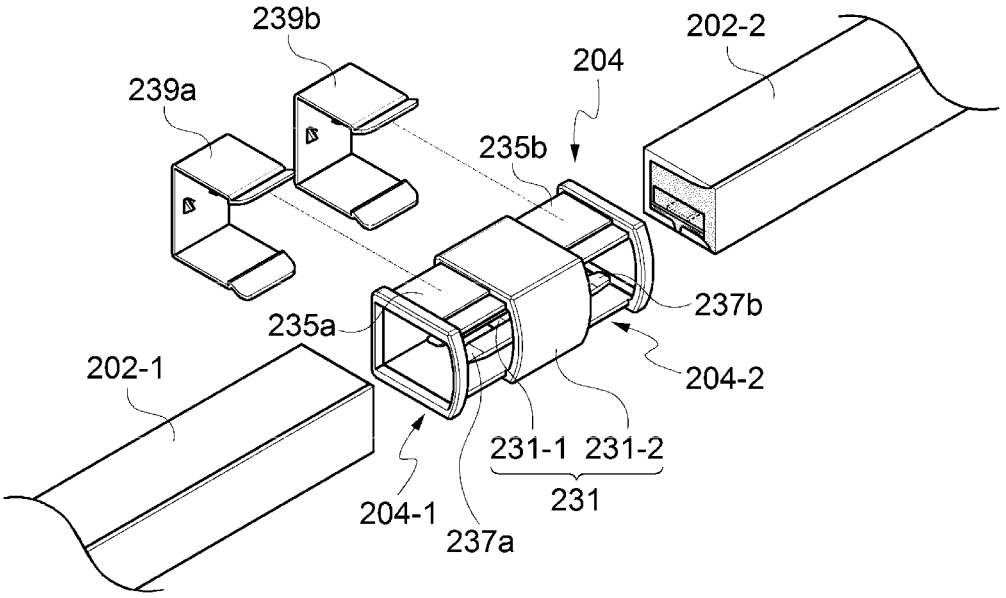
FIG. 7 is a perspective view illustrating a connection device according to another embodiment of the present disclosure.

FIG. 7 is a perspective view illustrating a connection device according to another embodiment of the present disclosure. Here, the configuration of the connection device for connecting two flexible lighting devices is illustrated.

That is, the embodiment described with reference to FIG. 3 illustrates a case in which one side of the connection device 104 is connected to the power supply (not shown), and the other side of the connection device 104 is connected to the flexible lighting device 102. On the other hand, the embodiment to be described with reference to FIG. 7 illustrates a case in which two flexible lighting devices are electrically connected through a connection device 204 as one side of the connection device 204 is connected to a first flexible lighting device 202-1, and the other side of the connection device 204 is connected to a second flexible lighting device 202-2.

Referring to FIG. 7, the connection device 204 may include a first connection device 204-1 connected to the first flexible lighting device 202-1 at one side of a body part 231 and a second connection device 204-2 connected to the second flexible lighting device 202-2 at the other side of the body part 231 with the body part 231 therebetween. The first connection device 204-1 and the second connection device 204-2 may be provided to be laterally symmetrical with respect to the body part 231.

The body part 231 may include a first body part 231-1 and a second body part 231-2. The first body part 231-1 may be provided to face ends of the first flexible lighting device 202-1 and the second flexible lighting device 202-2 in a space between the first flexible lighting device 202-1 and the second flexible lighting device 202-2. The second body part 231-2 may be provided to protrude toward the first flexible lighting device 202-1 and the second flexible lighting device 202-2 from each edge of the first body part 231-1.

The first connection device 204-1 may include a first lighting device guide part **235*a*, a first connection terminal 237*a*, and a first clip part 239*a*. Here, the first lighting device guide part 235*a*, the first connection terminal 237*a*, and the first clip part 239*a* are the same as or similar to the corresponding components illustrated in FIG. 3**, and thus descriptions thereof will be given briefly.

Here, the first lighting device guide part **235*a* may be provided to face the first flexible lighting device 202-1 from one side of the second body part 231-2. The first connection terminal 237***a* may be provided to protrude toward the first flexible lighting device 202-1 from one surface of the first body part 231-1. The first connection terminal 237*a* may be electrically connected to a wiring pattern of the first flexible lighting device 202-1. The first clip part 239*a* may be coupled to an outer side of the first lighting device guide part 235*a*. The first clip part 239*a* may be coupled to the first lighting device guide part 235*a* while closing one open side surface of the first lighting device guide part 235*a*. Here, the first clip part 239*a* may be brought into close contact with and fixed to a side surface of the first flexible lighting device 202-1, which is exposed to the outside due to one open side surface of the first lighting device guide part 235*a*.

The second connection device 204-2 may include a second lighting device guide part 235*b*, a second connection terminal 237*b*, and a second clip part 239*b*. The second lighting device guide part 235*b* may be provided to face the second flexible lighting device 202-2 from the other side of the second body part 231-2. The second connection terminal 237*b* may be provided to protrude toward the second flexible lighting device 202-2 from the other surface of the first body part 231-1. The second connection terminal 237*b* may be electrically connected to the first connection terminal 237*a* at the first body part 231-1. In an exemplary embodiment, the second connection terminal 237*b* may be provided integrally with the first connection terminal 237*a*. The second connection terminal 237*b* may be electrically connected to a wiring pattern of the second flexible lighting device 202-2.

The second clip part 239*b* may be coupled to an outer side of the second lighting device guide part 235*b*. The second clip part 239*b* may be coupled to the second lighting device guide part 235*b* while closing one open side surface of the second lighting device guide part 235*b*. Here, the second clip part 239*b* may be brought into close contact with and fixed to a side surface of the second flexible lighting device 202-2, which is exposed to the outside due to one open side surface of the second lighting device guide part 235*b*.

Meanwhile, although the first flexible lighting device 202-1 and the second flexible lighting device 202-2 are illustrated herein as being the first-type flexible lighting device, the present disclosure is not limited thereto, and one of the first flexible lighting device 202-1 and the second flexible lighting device 202-2 may be the first-type flexible lighting device and the other one may be the second-type flexible lighting device. In addition, both the first flexible lighting device 202-1 and the second flexible lighting device 202-2 may also be the second-type flexible lighting device.

Figure 8:
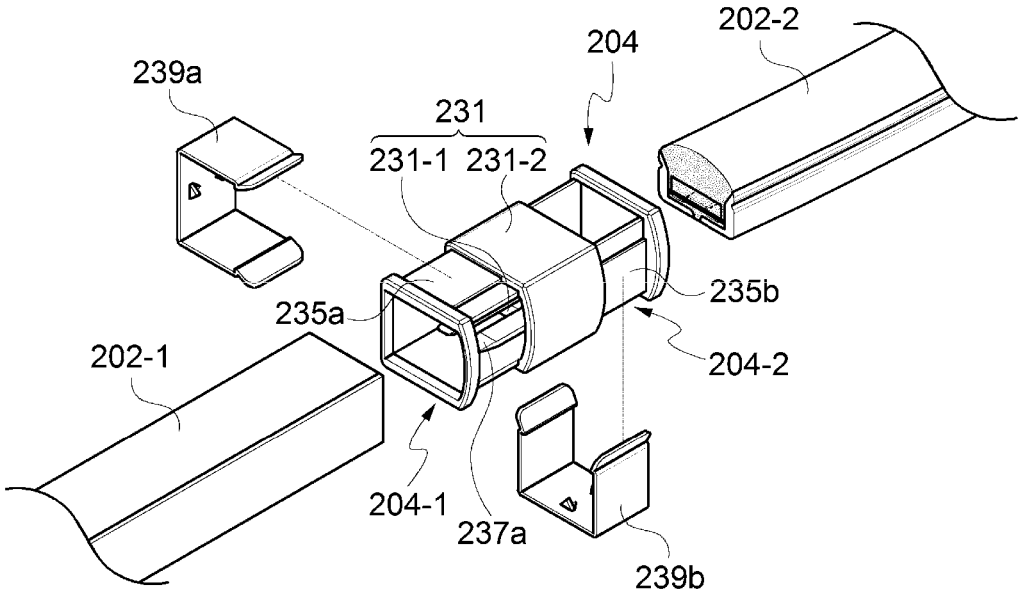
FIG. 8 is a perspective view illustrating a connection device according to still another embodiment of the present disclosure.

FIG. 8 is a perspective view illustrating a connection device according to still another embodiment of the present disclosure. Here, the configuration of the connection device for connecting the first-type flexible lighting device and the second-type flexible lighting device is shown. Hereinafter, the parts that are different from those of the embodiment described with reference to FIG. 7 will be mainly described.

Referring to FIG. 8, a first connection device 204-1 provided on one side of a body part 231 may be connected to a first-type flexible lighting device 202-1, and a second connection device 204-2 provided on the other side of the body part 231 may be connected to a second-type flexible lighting device 202-2.

Both side surfaces of a first lighting device guide part 235*a* of the first connection device 204-1 may be provided to be open. A first clip part 239*a* may be coupled to the first lighting device guide part 235*a* while closing one open side surface of the first lighting device guide part 235*a* at one side of the first lighting device guide part 235*a*.

The first clip part 239*a* may be and fixed to a side surface of the first-type flexible lighting device 202-1, which is exposed to the outside due to one open side surface of the first lighting device guide part 235*a*. Here, a surface of the first-type flexible lighting device 202-1 (that is, a surface to which light is irradiated), on which a light-shielding part is not formed, is positioned to face the other open side surface of the first lighting device guide part 235*a*.

On the other hand, an upper surface and a lower surface of a second lighting device guide part 235*b* of the second connection device 204-2 may be provided to be open. A second clip part 239*b* may be coupled to the second lighting device guide part 235*b* while closing an open lower surface of the second lighting device guide part 235*b* at a lower portion of the second lighting device guide part 235*b*.

The second clip part 239*b* may be brought into close contact with and fixed to a lower surface of the second-type flexible lighting device 202-2, which is exposed to the outside due to the open lower surface of the second lighting device guide part 235*b*. Here, a surface of the second-type flexible lighting device 202-2 (that is, a surface to which the light is irradiated), on which the light-shielding part is not formed, is positioned to face an open upper surface of the second lighting device guide part 235*b*.

Meanwhile, the first-type flexible lighting device 202-1 (a first-type light) and the second-type flexible lighting device 202-2 (a second-type light) may be variously arranged in the flexible lighting system. The first-type light and the second-type light may be arranged in various forms. For example, the first-type light and the second-type light may be repeatedly arranged, and a plurality of first-type lights are arranged and then a plurality of second-type lights are arranged, and through this, the lights may be displayed in various ways.

Further, since both side surfaces of the first connection device 204-1 are provided to be open, the first clip part 239*a* may be fixed to the side surface of the first-type flexible lighting device 202-1 through one open side surface of the first connection device 204-1, and a light irradiation direction of the first-type flexible lighting device 202-1 is exposed to the outside through the other open side surface of the first connection device 204-1, thereby minimizing light interference. In addition, since the upper surface and the lower surface of the second connection device 204-2 are provided to be open, the second clip part 239*b* may be fixed to the lower surface of the second-type flexible lighting device 202-2 through the open lower surface of the second connection device 204-2, and a light irradiation direction of the second-type flexible lighting device 202-2 is exposed to the outside through the open upper surface of the second connection device 204-2, thereby minimizing light interference.

Figure 9:
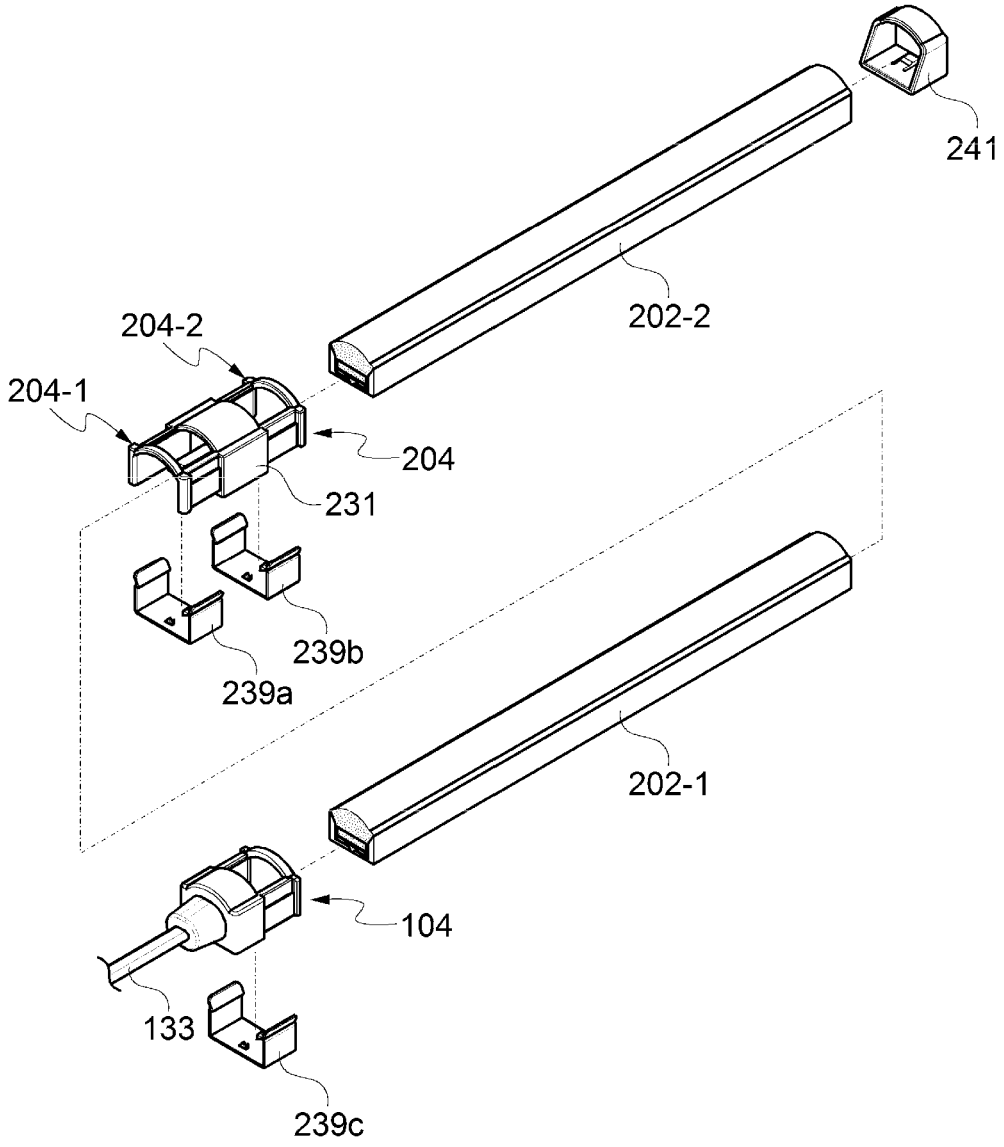
FIGS. 9 and 10 are views illustrating a state in which second-type flexible lighting devices are connected to each other through the connection device in a disclosed embodiment.
Figure 10:
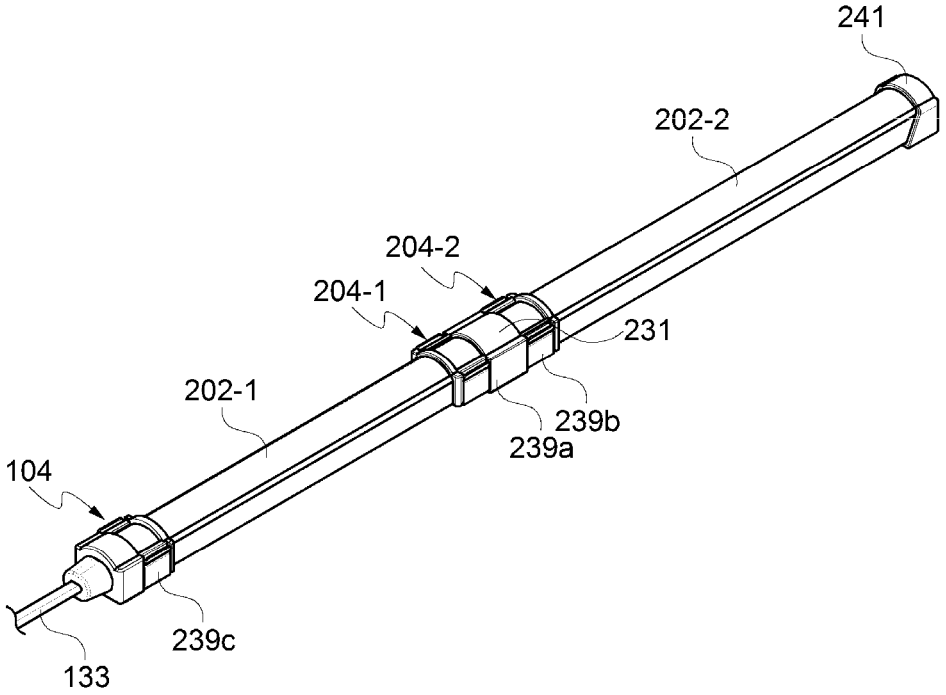

FIGS. 9 and 10 are views illustrating a state in which the second-type flexible lighting devices are connected to each other through the connection device in a disclosed embodiment.

Referring to FIGS. 9 and 10, the first flexible lighting device 202-1 and the second flexible lighting device 202-2 may each be the second-type flexible lighting device. The connection device 204 may connect the first flexible lighting device 202-1 to the second flexible lighting device 202-2 in a space between the first flexible lighting device 202-1 and the second flexible lighting device 202-2.

In the connection device 204, the first connection device 204-1 provided on one side of the body part 231 may be connected to one end of the first flexible lighting device

202-1, and the second connection device 204-2 provided on the other side of the body part 231 may be connected to one end of the second flexible lighting device 202-2. Here, the first clip part 239*a* may be coupled to the first connection device 204-1, and the second clip part 239*b* may be coupled to the second connection device 204-2.

Another connection device 104 may be connected to the other end of the first flexible lighting device 202-1. The power connection part 133 may be provided on one side of the connection device 104. The power connection part 133 may be electrically connected to the power supply (not shown). A third clip part 239*c* may be coupled to another connection device 104.

A finishing member 241 may be coupled to the other end of the second flexible lighting device 202-2. The finishing member 241 may protect the other end of the second flexible lighting device 202-2 from an external environment. The finishing member 241 may prevent the wiring pattern or the like of the second flexible lighting device 202-2 from being exposed to the outside.

Here, when power is supplied from the connection device 104 connected to the other end of the first flexible lighting device 202-1, the power is supplied to the second flexible lighting device 202-2 by being transmitted through the first flexible lighting device 202-1 and the connection device 204 that is connected to one end of the first flexible lighting device 202-1.

Figure 11:
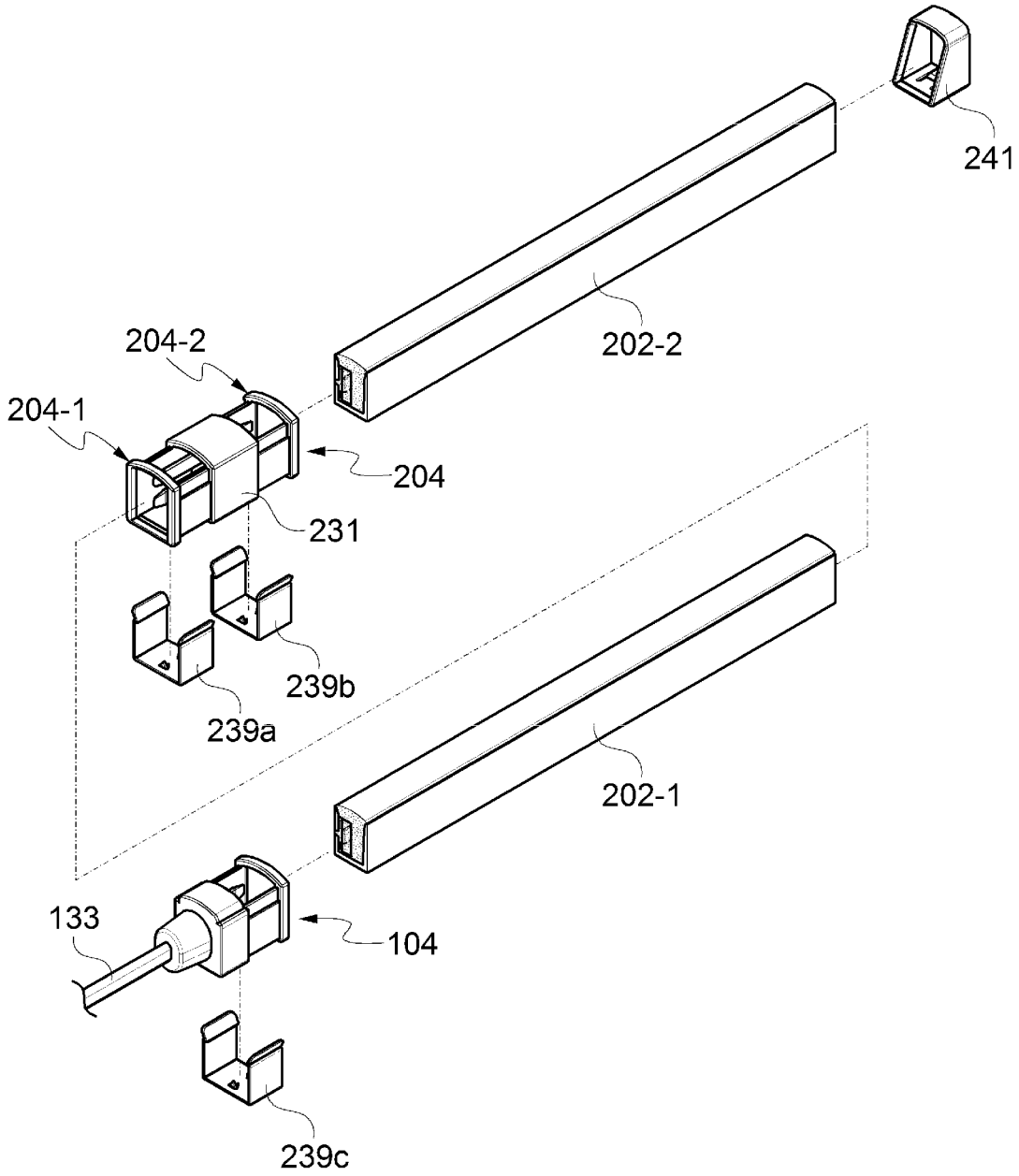
FIG. 11 is a view illustrating a state in which first-type flexible lighting devices are connected to each other through the connection device in a disclosed embodiment.

FIG. 11 is a view illustrating a state in which first-type flexible lighting devices are connected to each other through the connection device in a disclosed embodiment.

Referring to FIG. 11, the first flexible lighting device 202-1 and the second flexible lighting device 202-2 may each be the first-type flexible lighting device.

In the connection device 204, the first connection device 204-1 provided on one side of the body part 231 may be connected to one end of the first flexible lighting device 202-1, and the second connection device 204-2 provided on the other side of the body part 231 may be connected to one end of the second flexible lighting device 202-2. Here, the first clip part 239*a* may be coupled to the first connection device 204-1, and the second clip part 239*b* may be coupled to the second connection device 204-2.

Another connection device 104 may be connected to the other end of the first flexible lighting device 202-1. The power connection part 133 may be provided on one side of the connection device 104. The power connection part 133 may be electrically connected to the power supply (not shown). The third clip part 239*c* may be coupled to another connection device 104.

The finishing member 241 may be coupled to the other end of the second flexible lighting device 202-2. The finishing member 241 may protect the other end of the second flexible lighting device 202-2 from an external environment. The finishing member 241 may prevent the wiring pattern or the like of the second flexible lighting device 202-2 from being exposed to the outside.

Figure 12A:
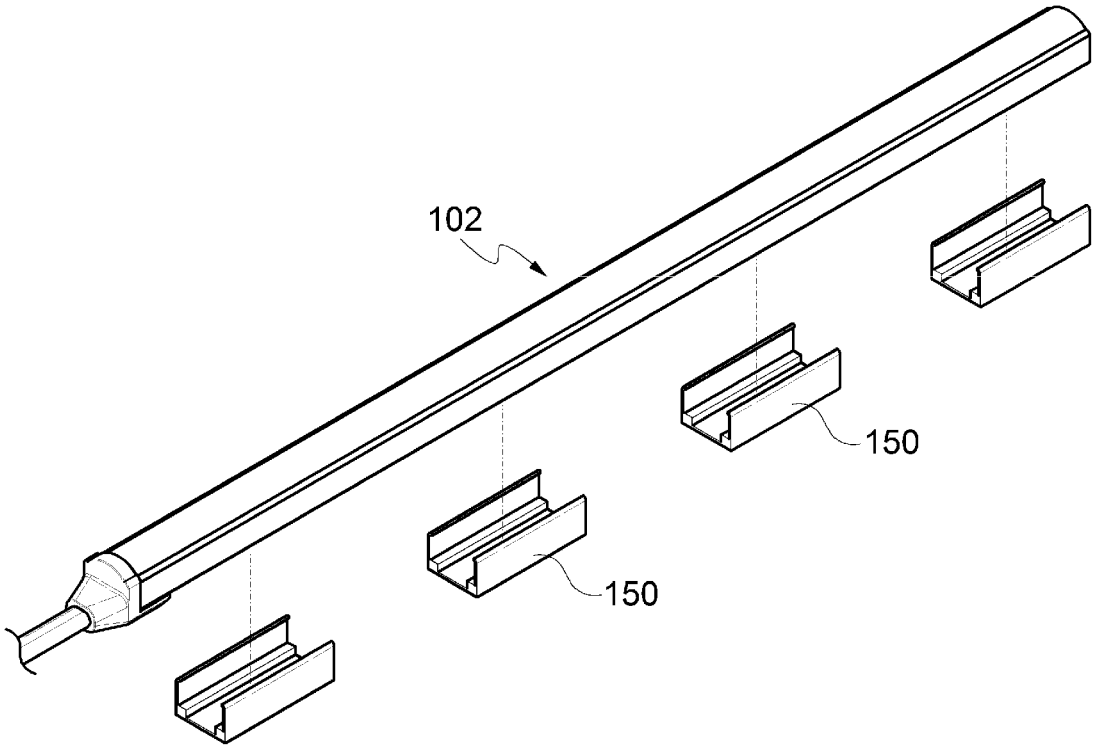
FIGS. 12A and 12B are a perspective view and a cross-sectional view, respectively, illustrating a state in which the flexible lighting device according to an embodiment disclosed herein is mounted on brackets.
Figure 12B:
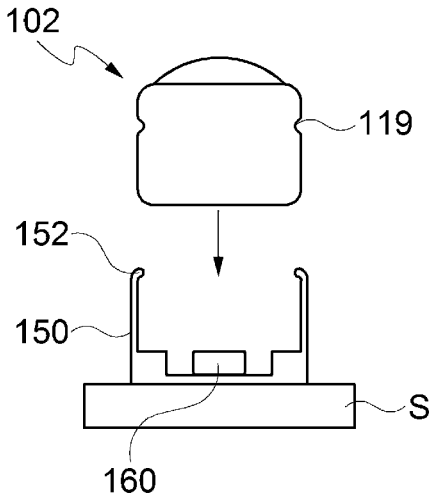

Meanwhile, the flexible lighting device 102 according to an embodiment of the present disclosure may be mounted on an installation surface through brackets. FIGS. 12A and 12B are a perspective view and a cross-sectional view, respectively, illustrating a state in which the flexible lighting device according to an embodiment disclosed herein is mounted on the brackets.

Referring to FIGS. 12A and 12B, a bracket 150 may be fixed to an installation surface S (for example, a wall or a ceiling) using a fixing member 160. A plurality of brackets 150 may be provided on the installation surface S by being spaced apart from each other. In an exemplary embodiment, the flexible lighting device 102 may be inserted into the bracket 150 by fitting and may be coupled thereto.

Mounting grooves 119 may be provided on both sides of the flexible lighting device 102. The mounting grooves 119 may be provided on the flexible lighting device 102 in the longitudinal direction of the flexible lighting device 102. When the flexible lighting device 102 is inserted into the bracket 150 by fitting, the mounting grooves 119 may be caught by the mounting parts 152 provided at upper ends of the bracket 150 so that the flexible lighting device 102 may be fixed and mounted.

Figure 13A:
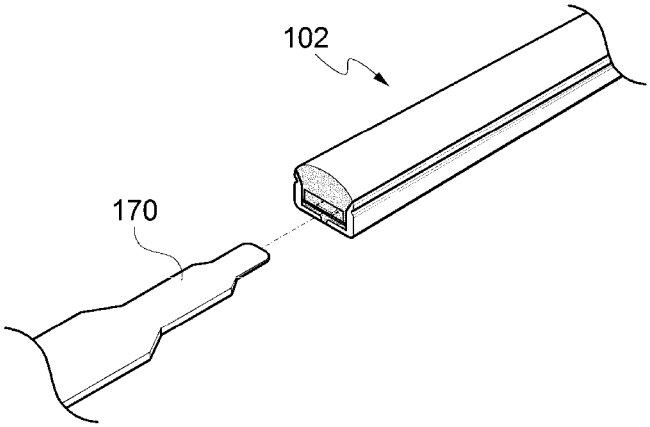
FIGS. 13A to 13C are views illustrating a process in which the connection device is connected to the flexible lighting device using an extended stick in an embodiment disclosed herein.
Figure 13B:
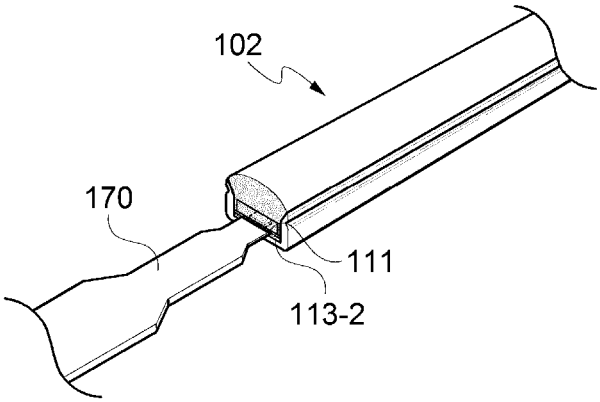
Figure 13C:
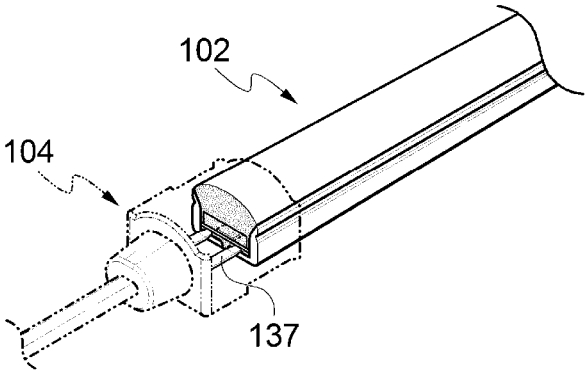

Further, in a disclosed embodiment, a separate extended stick may be used in order for the connection terminal 137 of the connection device 104 to be easily brought into contact with the wiring pattern 123 of the flexible lighting device 102. FIGS. 13A to 13C are views illustrating a process in which the connection device is connected to the flexible lighting device using the extended stick in an embodiment disclosed herein.

First, an extended stick 170 is prepared (see FIG. 13A). The extended stick 170 may be provided in the form of a bar and may be provided to be flattened (i.e., small in width and thickness toward an end thereof).

Next, an end portion of the extended stick 170 is inserted into a space between the flexible board 111 and the second protection part 113-2 of the flexible lighting device 102 (see FIG. 13B). That is, the flexible board 111 and the second protection part 113-2 are spread apart from each other in advance using the extended stick 170.

Subsequently, the flexible lighting device 102 is inserted into the connection device 104 (see FIG. 13C). Here, since the flexible board 111 and the second protection part 113-2 are spread apart from each other using the extended stick 170, the connection terminal 137 of the connection device 104 is brought into contact with the wiring pattern 123 while being easily inserted into a space between the flexible board 111 and the second protection part 113-2.

According to an embodiment of the present disclosure, a connection device can be stably coupled to a flexible lighting device by coupling a clip part of the connection device to an outer side of a lighting device guide part on one open side surface of the lighting device guide part. In addition, by providing one or more fixing protrusions with a pointed shape on a surface of the clip part, which faces one open side surface of the lighting device guide part, the fixing protrusions of the clip part can be stuck into and fixed to the one side surface of the flexible lighting device, which is exposed to the outside due to one open side surface of the lighting device guide part, so that the connection device can be more firmly coupled to the flexible lighting device.

Further, by providing cutting marks on a lower surface of a flexible board so as to be identifiable from the outside, a user can accurately find and cut a portion of a flexible lighting device to be cut through the cutting marks even when the flexible lighting device is bent.

While representative embodiments of the present disclosure have been described above in detail, those skilled in the art should understand that the embodiments may be variously modified without departing from the scope of the present disclosure. Therefore, the scope of the present disclosure is defined not by the described embodiment but by the appended claims and encompasses equivalents that fall within the scope of the appended claims.

What is claimed is:

1. A connection device that is connected to a flexible lighting device, the connection device comprising:

a body part;

a connection terminal protruding toward the flexible lighting device from the body part and electrically connected to the flexible lighting device;

a lighting device guide part provided to protrude toward the flexible lighting device from the body part, configured to guide the flexible lighting device to be inserted into the connection device, and having one or more side surfaces provided to be open; and a clip part coupled to an outer side of the lighting device guide part at one open side surface of the lighting device guide part and provided to be fixed to one side surface of the flexible lighting device which is exposed to the outside due to the one open side surface.

2. The connection device of claim 1, wherein the clip part includes at least one fixing protrusion provided on a surface thereof facing the one open side surface of the lighting device guide part; and the fixing protrusion is provided to be stuck into and fixed to the one side surface of the flexible lighting device, which is exposed to the outside due to the one open side surface, when the clip part is coupled to the outer side of the lighting device guide part.

3. The connection device of claim 1, wherein the lighting device guide part includes:

a first guide part extending toward the flexible lighting device from an upper end of the body part;

a second guide part extending toward the flexible lighting device from a lower end of the body part; and a support frame provided to connect an end of the first guide part to an end of the second guide part.

4. The connection device of claim 1, wherein the connection device further includes a power connection part provided in the body part at a side opposite to the flexible lighting device and having one side connected to the connection terminal and the other side electrically connected to a power supply.

5. The connection device of claim 1, wherein the clip part includes:

a first plate provided to face the one open side surface of the lighting device guide part;

a second plate protruding toward the lighting device guide part from an upper end of the first plate and provided with a first engaging part at an end thereof; and a third plate protruding toward the lighting device guide part from a lower end of the first plate and provided with a second engaging part at an end thereof.

6. The connection device of claim 5, wherein the lighting device guide part further includes:

a first engaging groove provided at an upper end of the lighting device guide part so that the first engaging part is caught by the first engaging groove; and a second engaging groove provided at a lower end of the lighting device guide part so that the second engaging part is caught by the second engaging groove.

7. The connection device of claim 5, wherein the clip part further includes at least one fixing protrusion provided to protrude from an inner surface of the first plate and stuck into and fixed to the one side surface of the flexible lighting device which is exposed to the outside due to the one open side surface of the lighting device guide part.

8. The connection device of claim 1, wherein the connection device is provided to connect two flexible lighting devices by forming the connection terminal, the lighting device guide part, and the clip part in a pair so as to be laterally symmetrical with respect to the body part.

9. The connection device of claim 1, wherein a connection device includes:

a first connection device provided at one side of a body part such that a first-type flexible lighting device is connected thereto and including a first connection terminal, a first lighting device guide part, and a first clip part; and a second connection device provided at the other side of the body part such that a second-type flexible lighting device is connected thereto and including a second connection terminal, a second lighting device guide part, and a second clip part.

10. A flexible lighting system comprising:

a flexible lighting device; and a connection device connected to the flexible lighting device, wherein the connection device includes:

a body part;

a connection terminal protruding toward the flexible lighting device from the body part and electrically connected to the flexible lighting device;

a lighting device guide part provided to protrude toward the flexible lighting device from the body part, configured to guide the flexible lighting device to be inserted into the connection device, and having one or more side surfaces provided to be open; and a clip part coupled to an outer side of the lighting device guide part at one open side surface of the lighting device guide part and provided to be fixed to one side surface of the flexible lighting device which is exposed to the outside due to the one open side surface.

11. The flexible lighting system of claim 10, wherein the clip part includes at least one fixing protrusion provided on a surface thereof facing the one open side surface of the lighting device guide part; and the fixing protrusion is provided to be stuck into and fixed to the one side surface of the flexible lighting device, which is exposed to the outside due to the one open side surface, when the clip part is coupled to the outer side of the lighting device guide part.

12. The flexible lighting system of claim 10, wherein the flexible lighting device includes:

a flexible board;

an illumination device provided on the flexible board;

a wiring pattern electrically connected to the illumination device on the flexible board; and at least one cutting mark provided on one surface of the flexible board in a longitudinal direction of the flexible board, wherein the cutting mark is provided to be identifiable from the outside.

13. The flexible lighting system of claim 12, wherein the wiring pattern is provided on a lower surface of the flexible board in the longitudinal direction of the flexible board; and the cutting mark is marked on the lower surface of the flexible board so as to be identifiable from the outside.

14. The flexible lighting system of claim 12, wherein the flexible lighting device further includes:

a protection part provided to cover at least one surface of the flexible board; and a light-shielding part provided on at least one outer surface of the flexible lighting device so that a direction of the illumination device coincides with a light irradiation direction of the flexible lighting device.

15. The flexible lighting system of claim 12, wherein the flexible lighting device further includes:

a protection part provided to cover at least one surface of the flexible board; and a light-shielding part provided on at least one outer surface of the flexible lighting device so that a direction of the illumination device does not coincide with a light irradiation direction of the flexible lighting device.

16. The flexible lighting system of claim 12, wherein the connection terminal is provided at a height corresponding to the wiring pattern such that an end of the connection terminal becomes smaller in thickness toward the flexible lighting device to be brought into contact with the wiring pattern.

* * * * *